US011612044B1

(12) United States Patent
Hedman

(10) Patent No.: US 11,612,044 B1
(45) Date of Patent: Mar. 21, 2023

(54) APPARATUS AND METHOD FOR WIRELESSLY IMPLEMENTING AND REMOTELY OPERATING A MULTICOLOR LANDSCAPE AND ARCHITECTURAL LIGHTING SYSTEM HAVING INDIVIDUALLY SELECTABLE FIXTURES, EACH INDIVIDUALLY HAVING PROGRAMMABLE AND MODIFIABLE WHITE OR MULTI-COLORED LIGHTING DISPLAYS THAT ARE ABLE TO BE COMBINED TO CREATE MULTIPLE LIGHTING SCENES

(71) Applicant: Todd Hedman, Yorkville, IL (US)

(72) Inventor: Todd Hedman, Yorkville, IL (US)

( * ) Notice: Subject to any disclaimer, the term of this patent is extended or adjusted under 35 U.S.C. 154(b) by 0 days.

(21) Appl. No.: 16/941,147

(22) Filed: Jul. 28, 2020

Related U.S. Application Data

(60) Provisional application No. 62/853,536, filed on May 28, 2019.

(51) Int. Cl.

| | |
|---|---|
| ***H05B 47/19*** | (2020.01) |
| ***F21V 23/00*** | (2015.01) |
| ***F21V 23/04*** | (2006.01) |
| ***H05B 45/20*** | (2020.01) |
| ***F21V 21/08*** | (2006.01) |
| ***F21Y 113/10*** | (2016.01) |
| ***F21Y 115/10*** | (2016.01) |

(52) U.S. Cl.
CPC ..... *H05B 47/19* (2020.01); *F21V 21/0824* (2013.01); *F21V 23/003* (2013.01); *F21V 23/0435* (2013.01); *H05B 45/20* (2020.01); *F21Y 2113/10* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2006/0120067 | A1* | 6/2006 | Kuelbs | A45B 3/04 362/129 |
| 2006/0187656 | A1* | 8/2006 | Kuelbs | F21S 9/035 362/183 |
| 2008/0211412 | A1* | 9/2008 | Chen | H05B 45/20 315/152 |
| 2009/0122564 | A1* | 5/2009 | Beadle | F21V 21/0824 362/431 |
| 2011/0133655 | A1* | 6/2011 | Recker | H05B 47/13 315/159 |
| 2012/0327639 | A1* | 12/2012 | Chen | F21S 9/035 362/183 |
| 2013/0134891 | A1* | 5/2013 | Woytowitz | H05B 47/175 315/201 |

(Continued)

*Primary Examiner* — Crystal L Hammond
(74) *Attorney, Agent, or Firm* — Scherrer Patent & Trademark Law, P.C.; Stephen T. Scherrer; Monique A. Morneault

(57) ABSTRACT

Landscape lighting fixtures are connected to a wireless network allowing users to individually select and adjust the colored LED light display for each fixture, when employing a smart phone or other program or device. A network connection and power module associated with each fixture resides outside the fixture housing, and is enclosed and effectively waterproof.

19 Claims, 8 Drawing Sheets

(56) References Cited

U.S. PATENT DOCUMENTS

| | | | | |
|---|---|---|---|---|
| 2014/0119022 | A1* | 5/2014 | Beausoleil | F21S 8/032<br>362/294 |
| 2015/0345764 | A1* | 12/2015 | Hussey | H05B 33/00<br>362/235 |
| 2015/0362157 | A1* | 12/2015 | Beausoleil | F21V 21/30<br>362/232 |
| 2016/0366746 | A1* | 12/2016 | van de Ven | F21K 9/235 |
| 2018/0299084 | A1* | 10/2018 | Chien | F21V 13/02 |

* cited by examiner

APPARATUS AND METHOD FOR WIRELESSLY IMPLEMENTING AND REMOTELY OPERATING A MULTICOLOR LANDSCAPE AND ARCHITECTURAL LIGHTING SYSTEM HAVING INDIVIDUALLY SELECTABLE FIXTURES, EACH INDIVIDUALLY HAVING PROGRAMMABLE AND MODIFIABLE WHITE OR MULTI-COLORED LIGHTING DISPLAYS THAT ARE ABLE TO BE COMBINED TO CREATE MULTIPLE LIGHTING SCENES

SUMMARY

The present technology connects one or more landscape and architectural lighting fixtures to a wireless network thereby allowing the user to individually select and adjust the colored LED light display for each fixture, when employing a smart phone app or other program or device (e.g., tablet, computer). A network connection and power module ("NCPM") is associated with each fixture, resides outside the fixture housing, and is enclosed and effectively waterproof. Each NCPM includes the fixture power supply, the wireless network receiver and transmitter (transceiver), the fixture's light driver, and an antenna to send and receive the wireless signals. By allowing the use of an increased power supply, which provides brighter more vivid colors, the present technology solves the problems associated with landscape light internal components that supply far less power and dimmer LED output, less vivid colored LED illumination, overheated fixtures, LED degradation-causing decreased LED lifespan, which results from the inability of the fixtures with internal power supplies to adequately dissipate heat. The present invention further solves problems associated with internal fixture wireless networking components because the NCPMs have a superior signal reception and transmission due to the use of a non-metallic ABS (or like material) encased Bluetooth mesh network transceiver antenna, which uses a Bluetooth Mesh network (or the like), greatly enhancing the effectiveness of the entire wireless network by allowing effective transmission and reception of wireless signals to and from each individual fixture because the external NCPMs have superior signal reception and transmission which permits greater distances between each communicable NCPM, better enabling the ability of each fixture to properly operate as described in the present invention.

DETAILED DESCRIPTION

Landscape, or architectural lighting refers to the use of outdoor low-voltage fixtures to illuminate homes, buildings, private gardens, and private and public landscapes. Landscape lighting enhances the aesthetic appearance of the homes, buildings, private gardens and, private and public landscapes and also enhances safety, accessibility, security, recreation and sports, and both residential and non-residential social event uses.

The landscape lighting fixtures employed in the present invention may be any number and types of typical fixtures (e.g., spotlights, path and area lights, floodlights, wall wash lights, well lights, deck lights, step lights and including but not limited to hardscape lights). Moreover, the light emitters (i.e., bulbs) used in the fixtures may vary (e.g., incandescent, halogen, LED, COB LED). Power supplied to the fixtures originate from one or more low-voltage transformers connected to the user's (home, business, building, etc.) electrical service.

Figure 1:
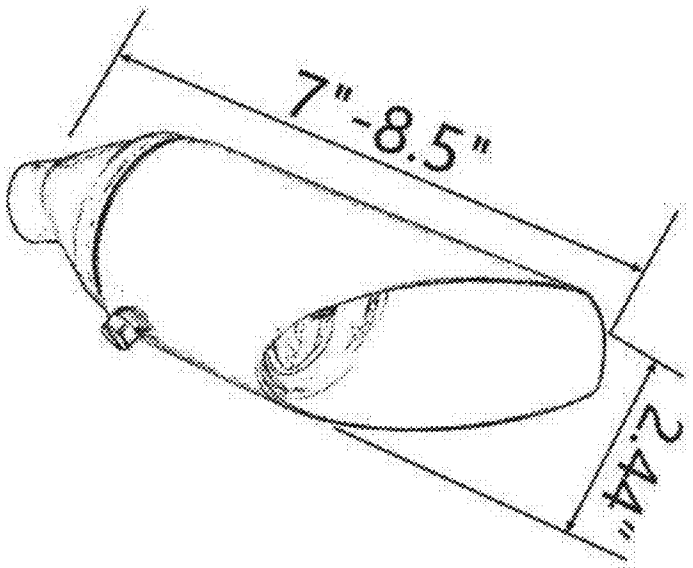
FIG. 1 illustrates typical landscape lighting fixtures that may be used with the present invention.
Figure 1:
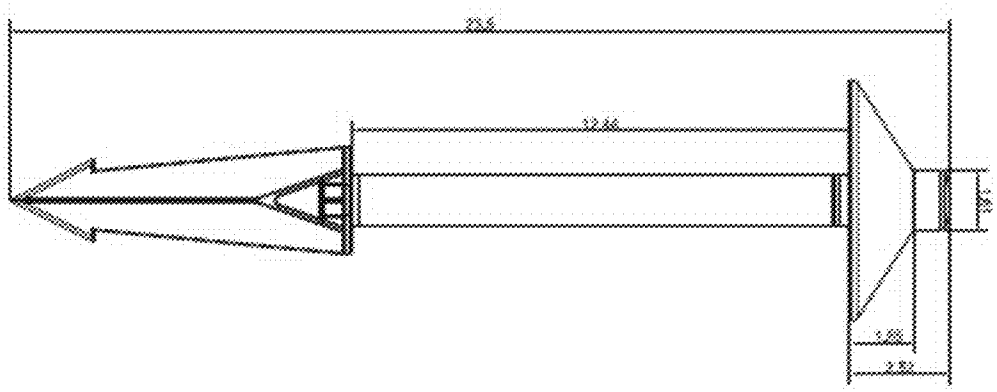

FIG. 1 illustrates typical landscape lighting fixtures that may be used with the present invention.

In a preferred embodiment, a chip on board ("COB") LED is employed in each fixture to permit the user to select and project a broad array of different colors (including white) on the visible spectrum, at varying clarity and intensity. Types of multi-color and white COB LEDs are manufactured by numerous manufacturers.

Figure 2:
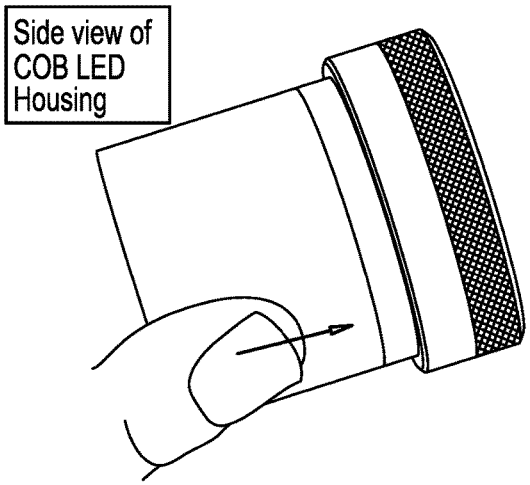
FIGS. 2, 3, and 4 illustrate how and where the COB LEE) is placed in a preferred embodiment of the present invention.
Figure 3:
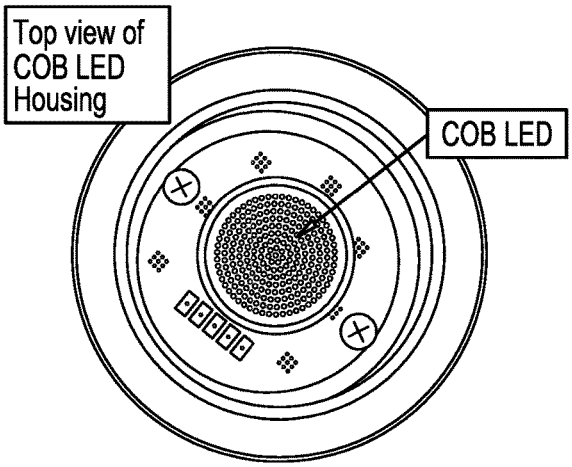
Figure 4:
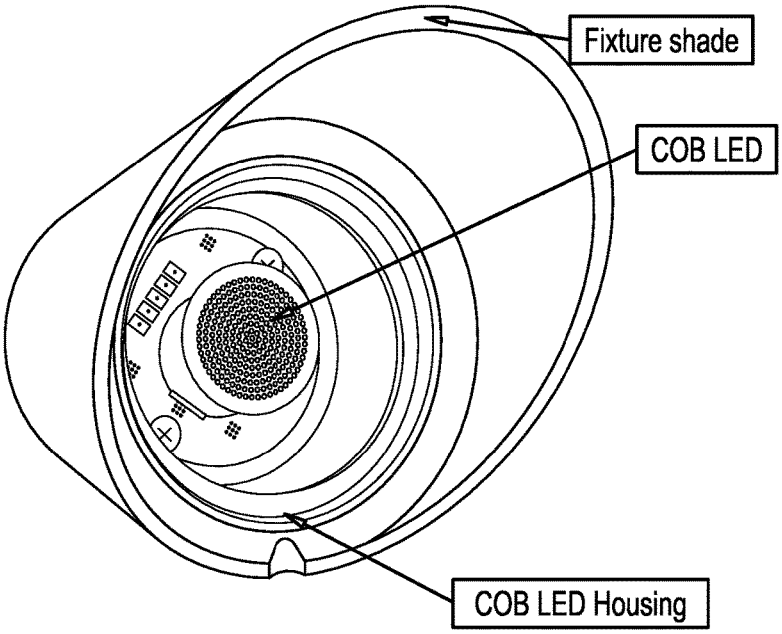

FIGS. 2, 3, and 4 illustrate how and where the COB LEE) is placed in a preferred embodiment of the present invention.

Figure 5:
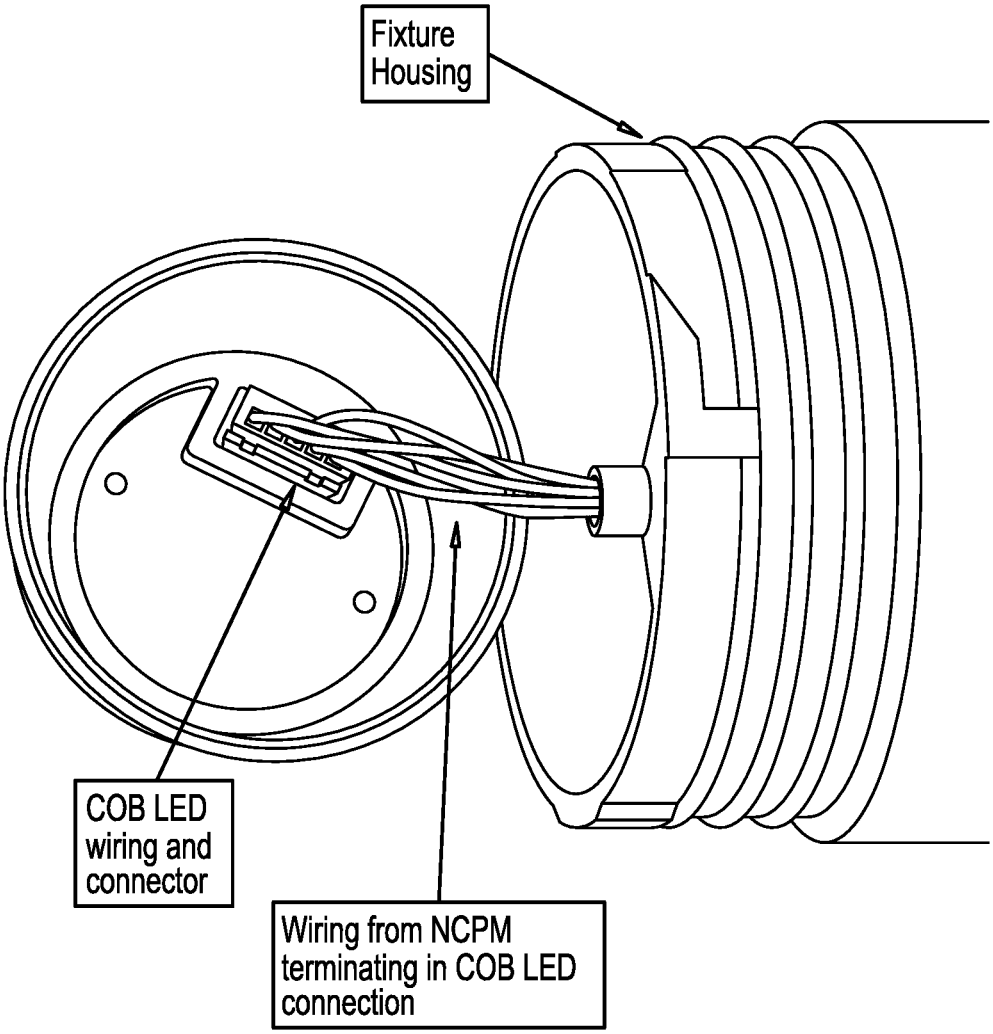
FIG. 5 illustrates how the COB LED is connected to the NCPM through the fixture body in a preferred embodiment of the present invention.

FIG. 5 illustrates how the COB LED is connected to the NCPM through the fixture body in a preferred embodiment of the present invention.

The landscape lighting fixtures of the present technology are each, individually connected to a wireless network such that the user may, for each fixture, employ an app or program, described herein to: assign an identifying name, for example, the fixture location (e.g., Front Yard, Garage, Front Door, Column); turn the fixture on or off; and select or change the projected light color, the projected light strength, and the projected light display. Further, the fixtures may be selected to operate independently or together with one or more other networked fixtures pursuant to a preselected or user-programmed display.

In a preferred embodiment, a typical Bluetooth Mesh network is used to identify, connect, and operate, via the reception and transmission of the Bluetooth signal to and from NCPMs physically wired to each of the fixtures, based on the user's desired landscape lighting sections or program.

Each of the landscape lighting fixtures of the present technology wirelessly connect to and interact with the network via an NCPM. The NCPM includes the fixture's power supply, a wireless network receiver and transmitter (transceiver), an antenna, the COB LED driver, and is hard wired to the fixture to provide power and drive the light display. Because the power supply of the present technology is external to the fixture itself, a preferred embodiment provides a 20-watt supply instead of the prior a power supply, thereby producing a more vivid and brilliant lighting display.

Figure 6:
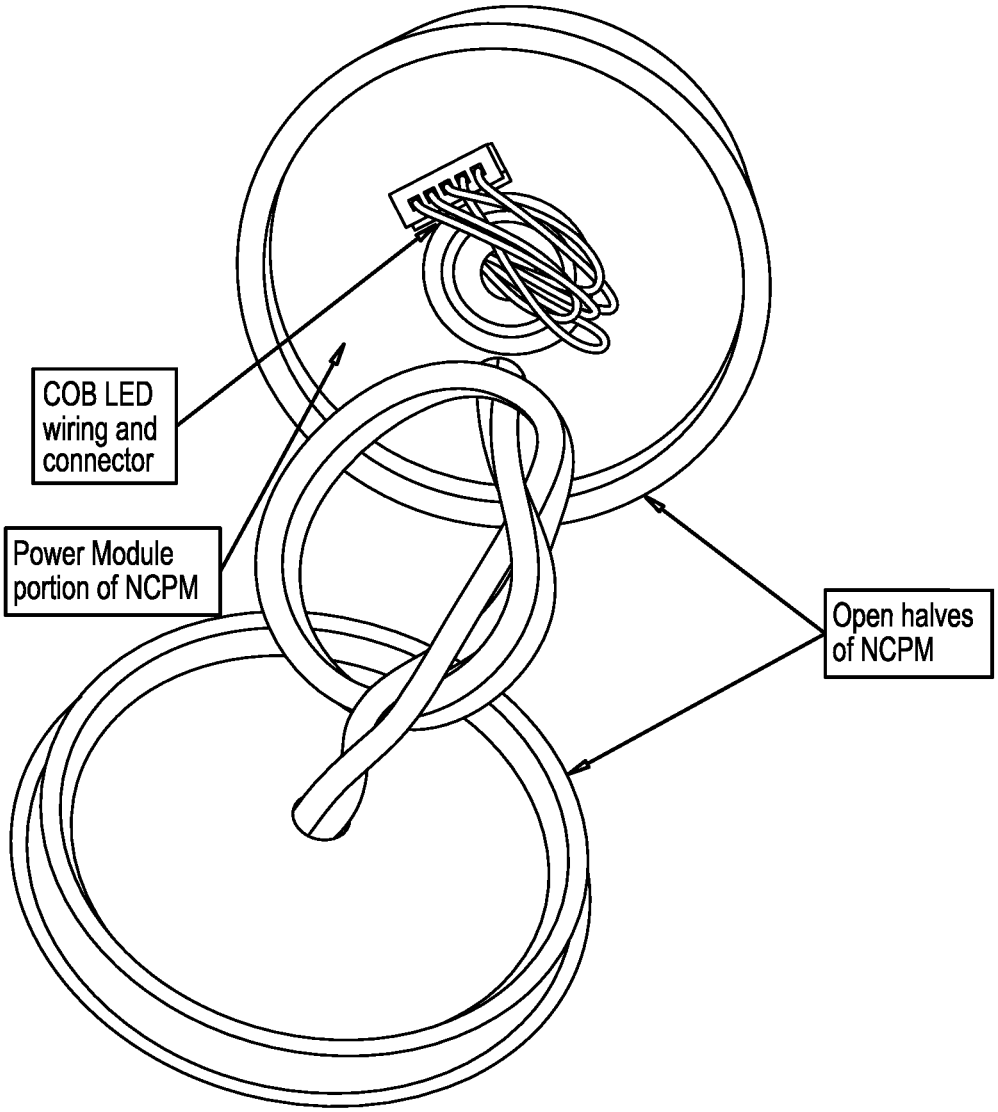
FIG. 6 illustrates the NCPM, and its construction in a preferred embodiment of the present invention.

FIG. 6 illustrates the NCPM, and its construction in a preferred embodiment of the present invention.

In a preferred embodiment, the NCPM is encapsulated and effectively waterproof, resides outside of the fixture housing, and made of suitable material that both allows for outdoor use and the efficient receipt and transmission of the Bluetooth Mesh signals.

In a preferred embodiment, the NCPM is constructed from acrylonitrile butadiene styrene ("ABS") (to encourage efficient heat transfer and dissipation), has a waterproof/water-resistant passage that allows wiring to enter the NCPM and connect the fixture to the NCPM internal components.

In a preferred embodiment, the NCPMs may be attached to the outside of the fixture, to the fixture mount (e.g., stake, pole, rod), placed on ground in proximity to the fixture, or on a its own stake (not having a fixture and acting as a repeater to receive and transmit Bluetooth Mesh signals as bridge for long spaces between fixtures.

In a preferred embodiment, the NCPM is threaded according to industry standards and mountable to a stake, stand, or fixture base.

Figure 7:
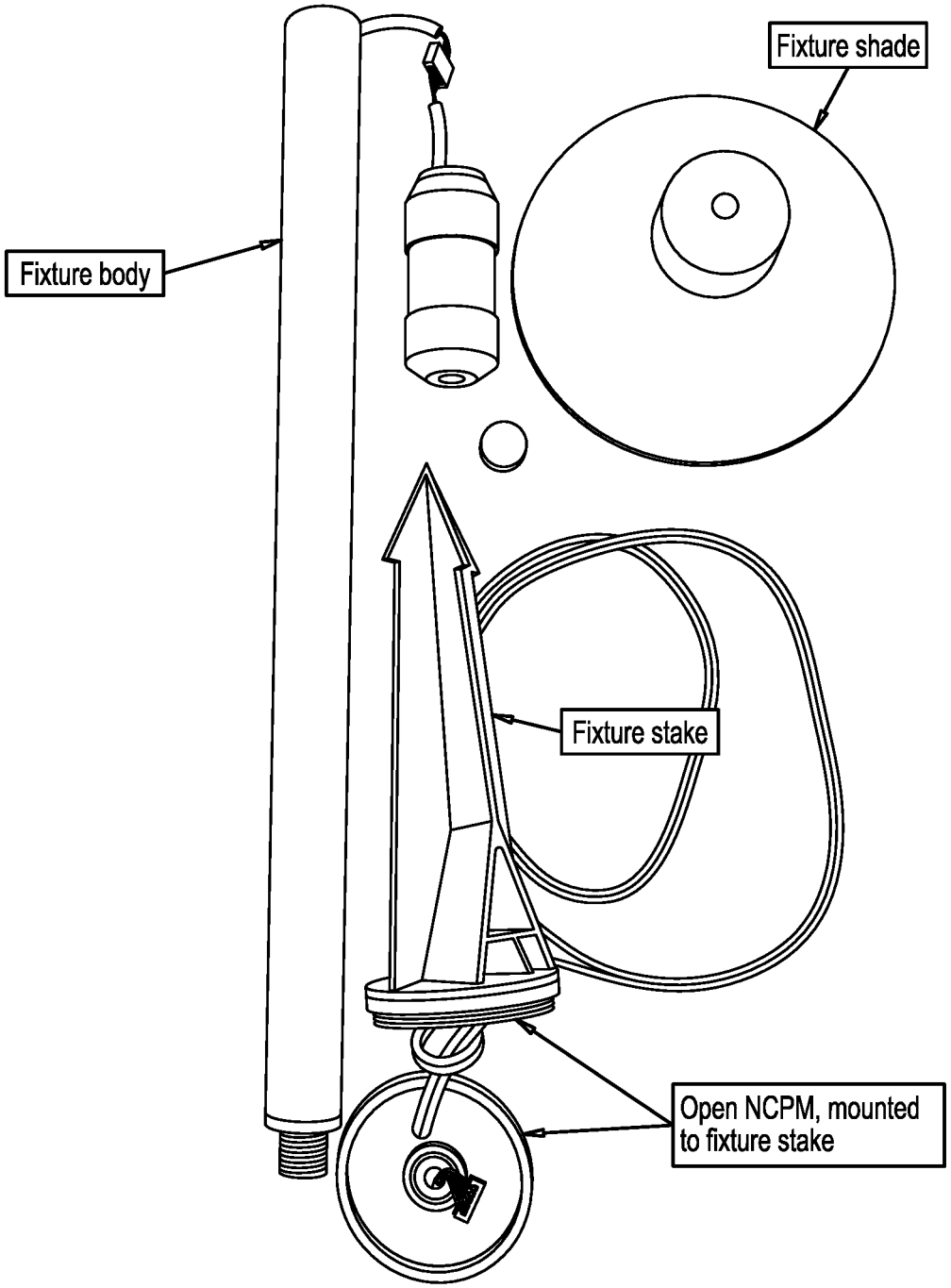
FIGS. 7, 8, and 9 illustrate the possible manners in which the NCPM can be mounted to the fixture base, stand, or stake in a preferred embodiment of the present invention.
Figure 8:
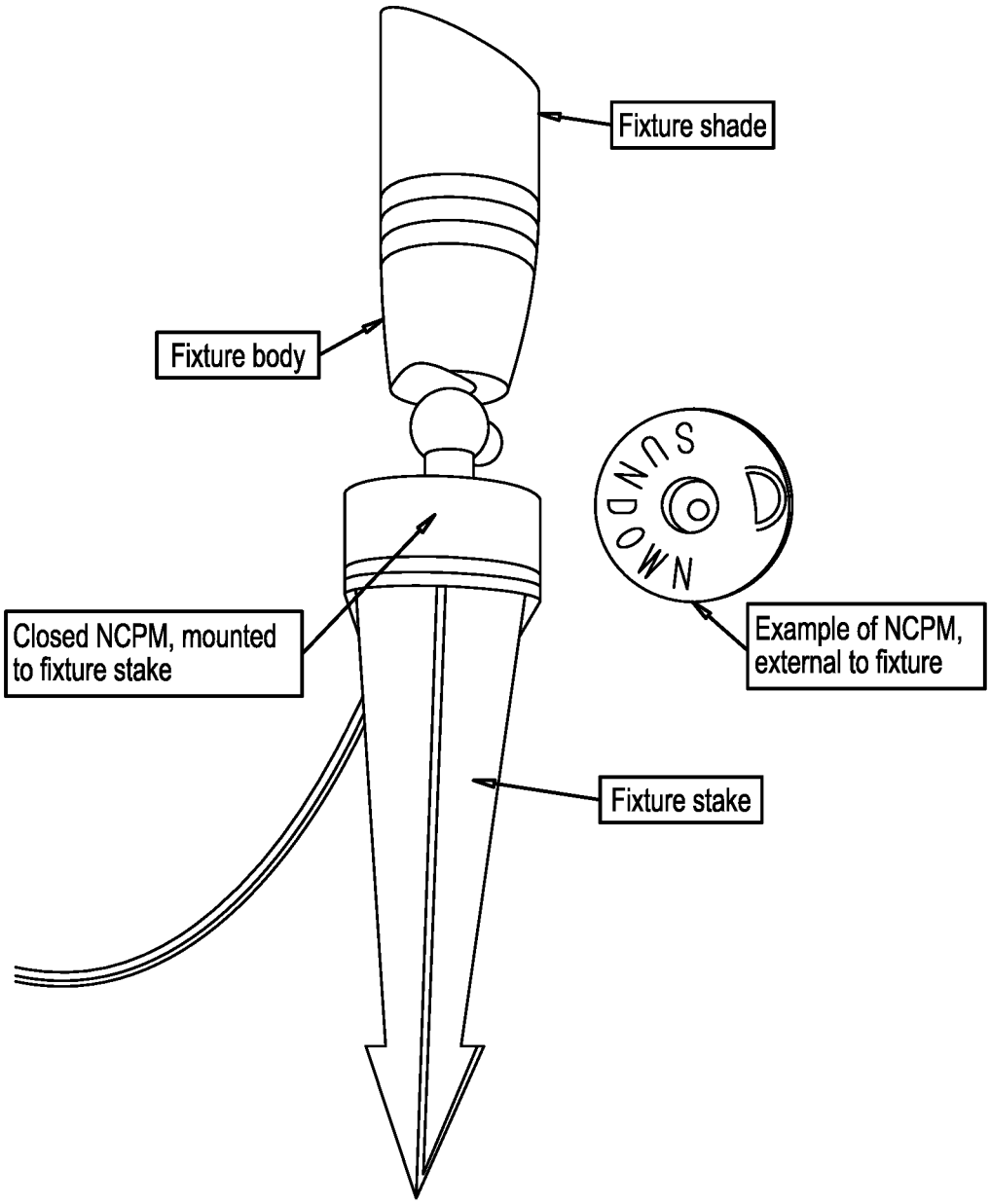
Figure 9:
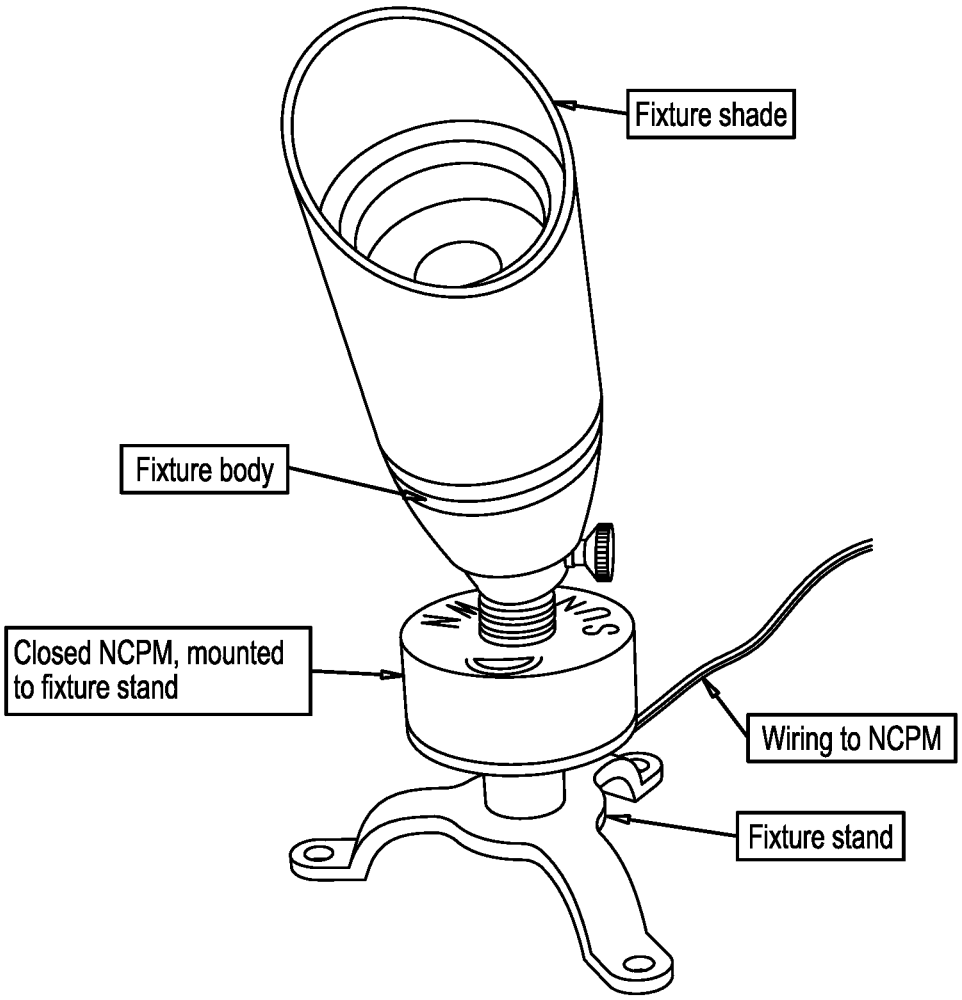
Figure 10:
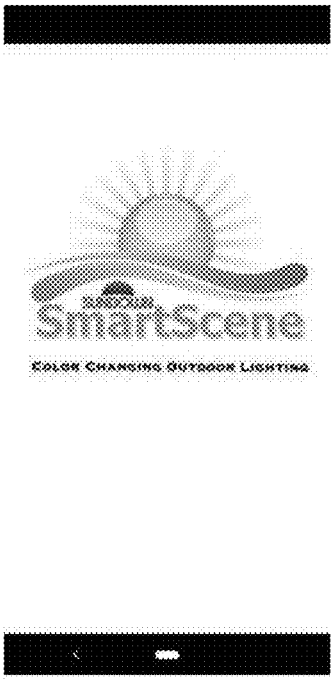
FIGS. 10-14 illustrate some of the functions, according to a preferred embodiment of the present invention, that a user can choose to customize and monitor a lighting scene.
Figure 11:
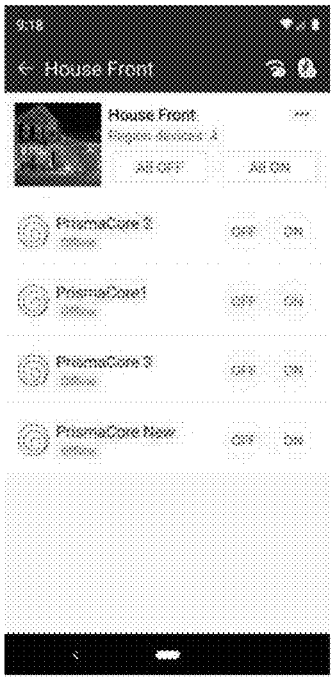
Figure 12:
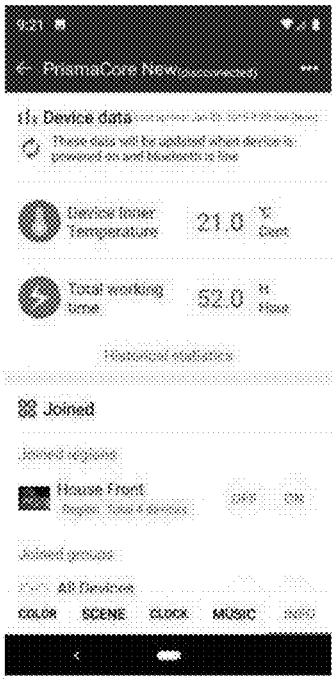
Figure 13:
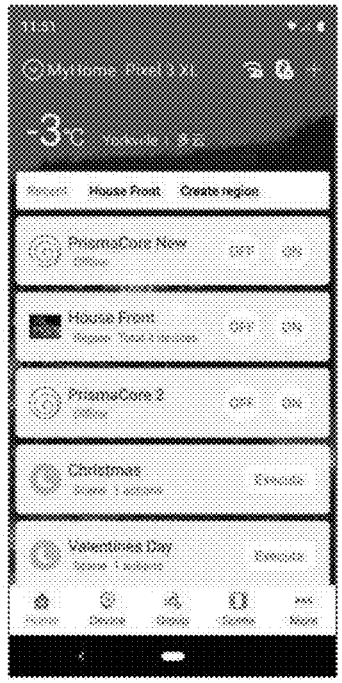

FIGS. 7, 8, and 9 illustrate the possible manners in which the NCPM can be mounted to the fixture base, stand, or stake in a preferred embodiment of the present invention.

Placement of the power supply, driver, transceiver, and antenna outside of the fixture housing is advantageous as it solves the problems of fixture overheating, shortening the lifespan of the LEDs, and poor signal reception and transmission. Prior art fixtures use an internal 12-watt power supply to provide illumination that is dim, dull, and, nevertheless, overheats and reduces the LED or halogen bulb lifespan.

Moreover, because the NCPM's are external to landscape lighting fixtures, the NCPMs may be used with both proprietary as well as another company's fixtures to provide the user's programmable light display, as described herein.

The present technology therefore allows the user to independently register each fixture with the network, and to select and program the parameters associated with each networked landscape lighting fixture.

In a preferred embodiment, and through the use of an app or program, the user can designate a specified number OF fixtures as a zone (e.g., House Front, Sidewalk, Entrance) and, either for each fixture, each zone, or the entire network, set a time and date to turn each fixture on and/or off; select and display a color from pre-programmed colors, programmed scenes/themes (e.g., Christmas, Halloween, St. Patrick's Day), from a pallet, or from a color wheel; adjust the brightness or brilliance, strobe or blink the display. The application or program can also, in a preferred embodiment, monitor the internal temperature of each fixture and the devices' working time.

Figure 14:
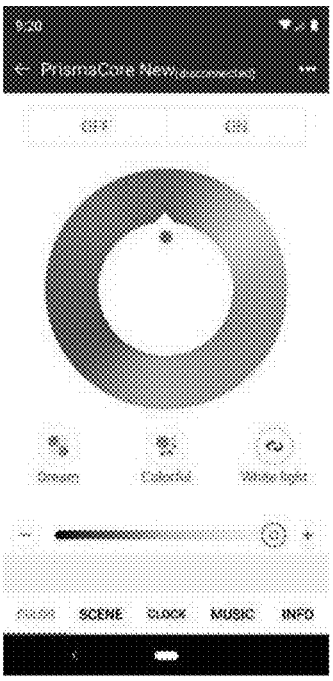

FIGS. 10-14 illustrate a possible mobile phone application (FIG. 10) whereby the user can select and name the fixtures (FIG. 11), monitor the fixtures' temperature and total working time (FIG. 12), chose from a pre-selected lighting display scene (FIG. 13), and select a any particular color, including white, from a color wheel (FIG. 14).

The above description is intended to enable to person skilled in the art to practice the invention. It is not intended to detail or alter possible variations any modifications that would become apparent to a skilled worker upon reading the description.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated.

I claim:

1. A landscape light fixture system comprising:

a first light fixture comprising a first fixture housing comprising a lamp compartment adapted to receive a lighting element, the lighting element comprising a multi-color LED light;

a first network connection and power module ("NCPM") associated with the first light fixture, wherein the first NCPM network connection and power module is disposed in a first NCPM housing outside the first fixture housing and thermally isolated from the first fixture housing, wherein the first NCPM network connection and power module comprises a first fixture power supply, a first wireless network transceiver, a first light driver, and first antenna for sending and receiving wireless signals a second light fixture comprising a second fixture housing comprising a lamp compartment adapted to receive a lighting element, the lighting element comprising a multi-color LED light; and a second NCPM associated with the second light fixture, wherein the second NCPM is disposed in a second NCPM housing outside the second fixture housing and thermally isolated from the second fixture housing, wherein the second NCPM comprises a second fixture power supply, a second wireless network transceiver, a second light driver, and a second antenna for sending and receiving wireless signals, wherein the landscape light fixture system is configured to operate via a low voltage power source, wherein the first light fixture and the second light fixture are configured to be controlled via a Bluetooth mesh network, wherein the first transceiver is configured to send wireless signals to the second transceiver.

2. The landscape light fixture system of claim 1 wherein the first network connection and power module is waterproof.

3. The landscape light fixture system of claim 1 wherein the first network connection and power module is encased in a non-metallic material.

4. The landscape light fixture system of claim 1 wherein the network connection and power module is encased in acrylonitrile butadiene styrene.

5. The landscape light fixture system of claim 1 wherein the first transceiver is configured to receive from and send wireless signals to the Bluetooth mesh network.

6. The landscape light fixture system of claim 1 wherein the first fixture power supply is connected to a low voltage power source.

7. The landscape light fixture system of claim 1 wherein the first multi-color LED light is a chip-on-board LED light.

8. The landscape light fixture system of claim 1 wherein the first fixture power supply is a 20-watt supply.

9. The landscape light fixture system of claim 1 further comprising a fixture mount.

10. A method of controlling a landscape light fixture comprising the steps of:

providing a landscape light fixture system configured to operate via a low voltage power source comprising:

a first light fixture comprising a first fixture housing comprising a first lamp compartment adapted to receive a first lighting element, the first lighting element comprising a first multi-color LED light;

a first network connection and power module ("NCPM") associated with the first light fixture, wherein the first NCPM network connection and power module is disposed in a first housing outside the first fixture housing and thermally separated from the first fixture housing, wherein the first NCPM network connection and power module comprises a first fixture power supply, a first wireless network transceiver, a first light driver, and a first antenna for sending and receiving wireless signals;

providing a second light fixture comprising a second fixture housing comprising a second lamp compartment adapted to receive a second lighting element, the second lighting element comprising a second multi-color LED light;

a second NCPM associated with the second light fixture, wherein the second NCPM is disposed in a second housing outside the second fixture housing and thermally separated from the second fixture housing, wherein the second NCPM comprises a second fixture power supply, a second wireless network transceiver, a second light driver, and a second antenna for sending and receiving wireless signals;

providing a wireless Bluetooth mesh network;

sending a first wireless signal to the first wireless network transceiver via the Bluetooth mesh network and receiving a second wireless signal from the first wireless network transceiver to the second wireless network transceiver via the Bluetooth mesh network; and controlling the first multi-color LED light within the first fixture housing via the first wireless signal Bluetooth mesh network and the first wireless network transceiver and controlling the second multi-color LED light within the second fixture housing via the second wireless signal.

11. The method of claim 10 wherein the first NCPM network connection and power module is waterproof.

12. The method of claim 10 wherein the first NCPM network connection and power module is encased in a non-metallic material.

13. The method of claim 10 wherein the first NCPM network connection and power module is encased in acrylonitrile butadiene styrene.

14. The method of claim 10 landscape light fixture of claim 1 wherein the first fixture power supply is connected to a low voltage power source.

15. The landscape method of claim 10 light fixture of claim 1 wherein the first multi-color LED light is a chip-on-board LED light.

16. The method of claim 10 landscape light fixture of claim 1 wherein the fixture power supply is a 20-watt supply.

17. A method of controlling a plurality of landscape light fixtures comprising the steps of:

providing a first landscape light fixture configured to operate via a low voltage power source comprising:

a first fixture housing comprising a first lamp compartment adapted to receive a first lighting element, the first lighting element comprising a first multi-color LED light;

a first network connection and power module ("NCPM") associated with the first light fixture, wherein the first network connection and power module is disposed within a first housing outside the first fixture housing and thermally separated from the first fixture housing, wherein the first NCPM network connection and power module comprises a first fixture power supply, a first wireless network transceiver, a first light driver, and a first antenna for sending and receiving wireless signals;

providing a second landscape light fixture comprising:

a second fixture housing comprising a second lamp compartment adapted to receive a second lighting element, the second lighting element comprising a second multi-color LED light;

a second NCPM network connection and power module associated with the second light fixture, wherein the second NCPM network connection and power module is disposed outside the second fixture housing, wherein the second network connection and power module comprises a second fixture power supply, a second wireless network transceiver, a second light driver, and a second antenna for sending and receiving wireless signals;

providing a wireless Bluetooth mesh network;

controlling the first multi-color LED light within the first fixture housing via a first wireless signal the Bluetooth mesh network and the first wireless network transceiver;

sending a second wireless signal from the first fixture to the second fixture; and controlling the second multi-color LED light within the second fixture housing via the second wireless signal Bluetooth mesh network and the second wireless network transceiver.

18. The method of claim 17 further comprising the step of:

providing a controller associated with the Bluetooth mesh network; and controlling the first and second multi-color LED lights via the controller.

19. The method of claim 18 wherein the controller is a mobile phone application.

* * * * *